United States Patent [19]

Frohbieter

[11] Patent Number: 4,503,583

[45] Date of Patent: Mar. 12, 1985

[54] ENCLOSURE WITH DOUBLE ACTING HINGE MECHANISM HAVING OVERCENTER LATCH

[75] Inventor: Edwin H. Frohbieter, Lincoln Township, Berrien County, Mich.

[73] Assignee: Whirlpool Corporation, Benton Harbor, Mich.

[21] Appl. No.: 427,113

[22] Filed: Sep. 29, 1982

[51] Int. Cl.[3] ..... E05D 15/50

[52] U.S. Cl. ..... 16/232; 16/366; 16/380; 16/DIG. 23; 292/52; 292/DIG. 49

[58] Field of Search ..... 16/230, 231, 232, 233, 16/257, 258, 259, 260, 263, 267, 268, 269, 270, 321, 323, 324, 325, 326, 327, 333, 335, 343, 345, 346, 347, 348, 349, 352, 357, 360, 366, 380, DIG. 32, DIG. 23; 49/382, 193; 292/DIG. 49, 126, 122, 220, 226, 336, 52

[56] References Cited

U.S. PATENT DOCUMENTS

| | | | |
|---|---|---|---|
| 100,160 | 10/1964 | Christensen . | |
| 321,266 | 6/1885 | Whitney . | |
| 418,255 | 12/1889 | Welter . | |
| 1,744,424 | 1/1930 | Trudeau | 292/DIG. 49 |
| 2,117,339 | 5/1938 | Claud-Mantle | 292/DIG. 49 |
| 2,711,803 | 6/1955 | Hurst . | |
| 2,886,375 | 5/1959 | Crawford . | |
| 3,020,084 | 2/1962 | Sylvester . | |
| 3,290,719 | 12/1966 | Courson . | |
| 3,889,419 | 6/1975 | Maleck . | |
| 4,222,149 | 9/1980 | Holbek . | |

*Primary Examiner*—Fred A. Silverberg

*Attorney, Agent, or Firm*—Wood, Dalton, Phillips, Mason & Rowe

[57] ABSTRACT

Door mounting structure for pivotally mounting a door to a cabinet for selectively closing an access opening of the cabinet and permitting the door to be opened from either side, as desired. The door mounting structure includes locking structure for effectively positively retaining the opposite side of the door in latched association with the hinge structure of the cabinet when the door is opened from either side. Operating structure is provided for closing a latch member from an open position as an incident of closing movement of the door portion carrying the latch. The door mounting structure is mounted within the upper and lower portions of the door for selective latched association with hinge pins mounted to the top and bottom of the cabinet.

10 Claims, 5 Drawing Figures

FIG. 1
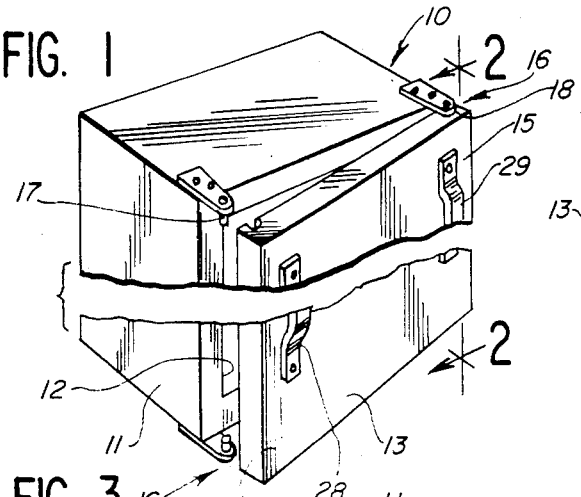
FIG. 2
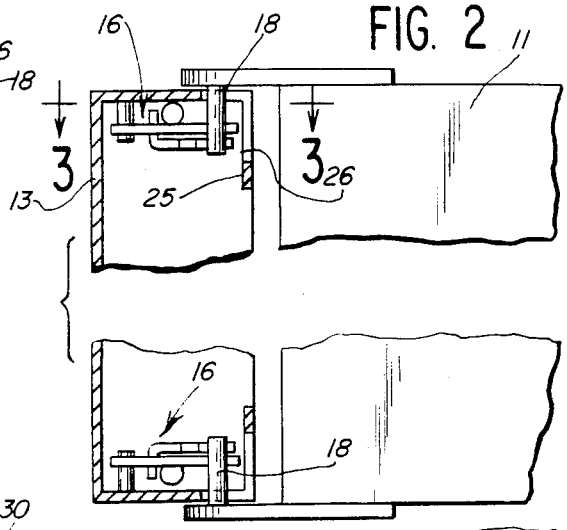
FIG. 3
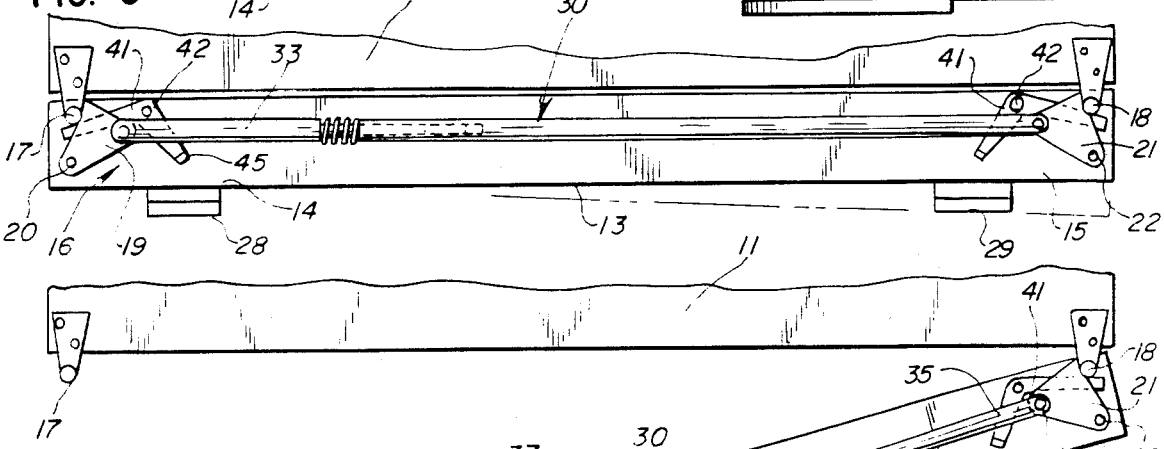
FIG. 4
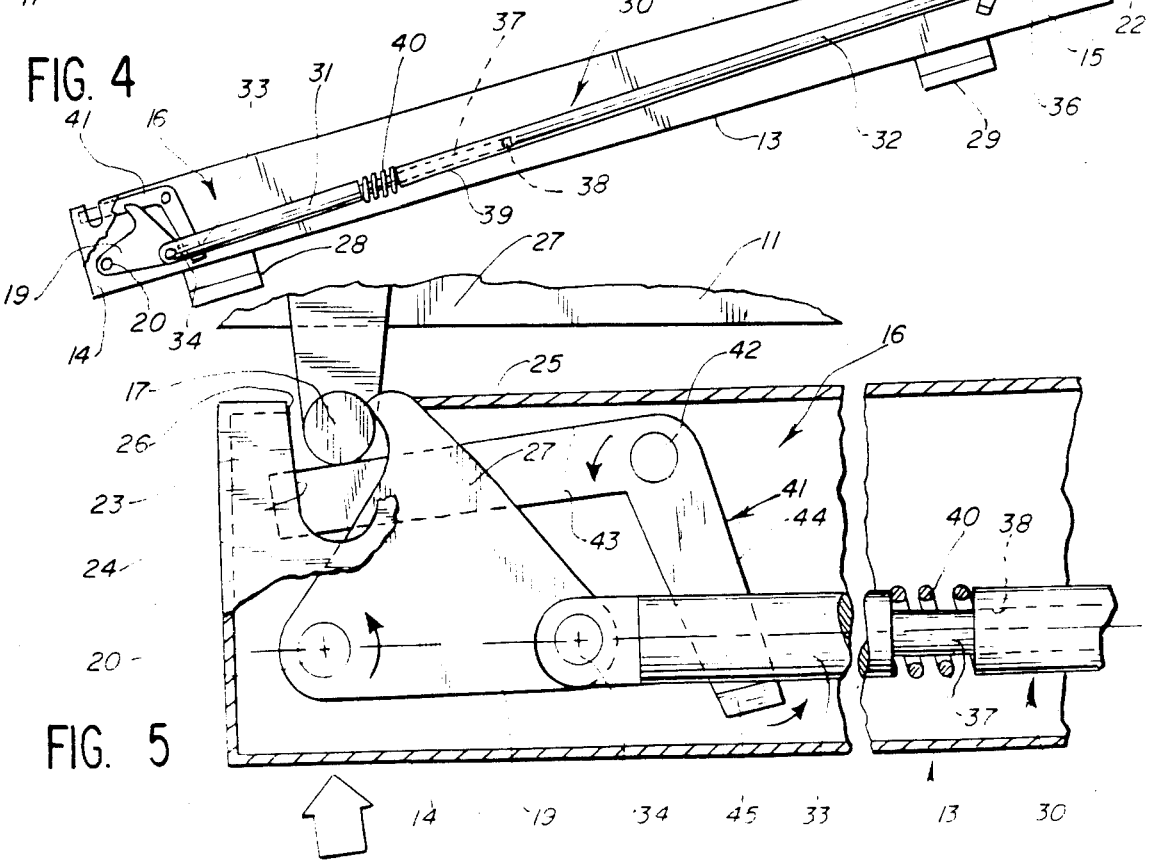
FIG. 5

ENCLOSURE WITH DOUBLE ACTING HINGE MECHANISM HAVING OVERCENTER LATCH

BACKGROUND OF THE INVENTION

1. Field of the Invention

This invention relates to enclosures having reversibly openable doors.

2. Description of the Prior Art

In refrigerators and the like, it is desirable to provide the access doors which open from either the left-hand or right-hand side of the cabinet. One example of such a refrigerator enclosure structure is illustrated in U.S. Pat. No. 3,889,419 of Leroy Maleck. As shown therein, the cabinet is provided with a hinge pin disposed in each corner of the access opening and the door is provided with a pair of bolt assemblies, each having a bolt member which is slidable into entrapping engagement with the hinge pin for the purpose of forming a hinge mounting adjacent either the left or right-hand side of the door. The door includes a pair of handles on the right and left-hand sides thereof. Each handle engages the bolt assemblies to shift the bolts to form the hinge assembly on the side opposite to the handle that is being actuated.

In U.S. Pat. No. 3,290,719, Iber C. Courson discloses a reversibly openable door provided with a doubleacting hinge construction which does not require manipulation of the latching apparatus as a separate operation prior to opening of the door. The door mounting structure includes a plurality of slidable links which are articulated and provide tracks for providing the desired reversible opening functioning.

SUMMARY OF THE INVENTION

The present invention comprehends an enclosure structure having an improved means for mounting a closure door to a cabinet so as to be openable from either the left-hand or right-hand side thereof.

In particular, the present invention is directed to an improved door mounting means which is suitable for use on refrigerators or the like where the door may be heavily loaded with food items, and wherein the door may be opened from either side by means of a fixed handle without requiring the user to manually operate a movable handle or latch prior to opening the door, while yet providing a positive hinging of the opposite side of the door from that being opened, so as to prevent accidental complete disengagement of the door from the cabinet.

More specifically, the invention comprehends the provision of such improved door mounting means including first hinge pin means fixed to the cabinet at one side of the opening, second hinge pin means fixed to the cabinet at the opposite side of the opening, a first latch member pivotally mounted to one side of the door for selective positioning in a latching position in latched association with the first hinge pin means and an overcenter open position, a second latch member pivotally mounted to the opposite side of the door for selective positioning in a latching position in latched association with the second hinge pin means and and overcenter open position, means on the door cooperating with the respective latch members to form retaining means effectively enclosing the respective hinge pins when the latch member is in the latching position, and locking means operably associated with each of the latch members for effectively maintaining either latch member in latching position in latched enclosing association with its associated hinge pin means as an incident of positioning of the other of the latch members in the open position thereof, thereby effectively maintaining the door hingedly mounted to the cabinet when the door is selectively opened from either side.

The invention also comprehends the provision of operating means including a first lever means movably mounted to the door at the one side for moving the first latch member from the overcenter open position into latching association with the first hinge pin means as an incident of the door being swung on the second hinge pin means from an open position to the closed position, and a second lever means movably mounted to the door at the opposite side for throwing the second latch member from the overcenter open position into latching association with the second hinge pin means as an incident of the door being swung on the first hinge pin means from an open position to the closed position.

Further, in the illustrated embodiment, the latch members are biased selectively to their overcenter closed and open positions by spring means. The spring means act, in the illustrated embodiment, between the latch members.

The locking means, in the illustrated embodiment, includes telescoping interconnecting means with biasing means acting between the telescoped parts of the interconnecting means for biasing the latch members to the latching and open positions.

In the illustrated embodiment, the door mounting means comprises a pair of similar mounting means structures, one structure being mounted at the top of the door and the other at the bottom of the door.

The door mounting means of the present invention is extremely simple and economical of construction while yet providing the highly desirable features discussed above.

BRIEF DESCRIPTION OF THE DRAWINGS

Other features and advantages of the invention will be apparent from the following description taken in connection with the accompanying drawings wherein:

FIG. 1 is a fragmentary perspective view of an enclosure structure having door mounting means embodying the invention;

FIG. 2 is a fragmentary vertical section thereof taken substantially along the line 2—2 of FIG. 1;

FIG. 3 is a fragmentary horizontal section taken substantially along the line 3—3 of FIG. 2;

FIG. 4 is a fragmentary horizontal section similar to that of FIG. 3 but with the door structure as arranged with the door opened from the left-hand side; and FIG. 5 is a fragmentary enlarged horizontal section illustrating the disposition of portions of the door mounting means as during movement of the door from the left side open position of FIG. 4 to a closed position thereof.

DESCRIPTION OF THE PREFERRED EMBODIMENT

In the illustrative embodiment of the invention as disclosed in the drawings, an enclosure structure generally designated 10 includes a cabinet 11 defining an access opening 12, which is selectively closed by a door 13 defining opposite sides 14 and 15. As seen in FIG. 1, side 14 comprises a left side of the door and side 15 comprises a right side of the door. The invention comprehends the provision of door mounting means generally designated 16 providing selective opening of the door from either the left side or the right side, as desired, from a closed position of the door across the opening 12.

As further illustrated in FIG. 1, the door mounting means comprises a pair of similar structures mounted one each at the top of the cabinet and door, and at the bottom of the cabinet and door. Each of the mounting means structures is similar and description of the structure thereof is limited herein to that of the top mounting means, it being understood that the description applies equally to the bottom mounting means.

As seen in FIGS. 1 and 3, the door mounting means includes a first hinge pin 17 fixed to the cabinet at the left side of opening 12, and a second hinge pin 18 fixed to the cabinet at the right side of the opening. A first latch member 19 is pivotally mounted to the left side of the door 13 by a first pivot 20 and an opposite, second latch member 21 is pivotally connected to the right side of the door by a second pivot 22. Each of the latch members is selectively positionable in a latching position, as shown in FIG. 3, and in an open position, as shown relative to latch member 19 in FIG. 4. As shown, the latching and open positions are overcentered relative to a center position illustrated in FIG. 5.

As shown in FIGS. 2 and 5, door 13 defines a top wall 23 provided with a U-shaped, rearwardly opening recess 24, and a downwardly turned, rear flange 25 provided with an opening 26 aligned with recess 24 cooperating with recess 24 for receiving and enclosing the hinge pin 17 when the door portion 15 is moved to the closed position of FIG. 3.

As further shown in FIG. 5, latching member 19 is provided with a rear latching portion 27 which, as shown in broken lines, is disposed rearwardly of the hinge pin 17 when the door portion 14 is moved to the closed position from the full line position illustrated in FIG. 5. In the closed position, as shown in FIG. 3, the hinge pin is received fully into the recess 24 so that the portion of top wall 23 defining the recess cooperates with the latch portion 27 in defining retaining means enclosing the hinge pin and retaining the door portion in closed position.

As illustrated in FIG. 1, door 13 is further provided with a left handle 28 and a right handle 29 at left side 14 and right side 15, respectively. Thus, when it is desired to open the door from the left side 14, the user pulls on handle 28 so as to pivot the door about its right-hand connection to the hinge pins 18, the pivotal connection at the right-hand side of the door being maintained by the disposition of the right-hand latching member 21 in the closed position illustrated in FIG. 4. As best seen in FIG. 4, right-hand latch member 21 is maintained in the latching position by a locking structure generally designated 30 interconnected between the latch members. Locking structure 30 includes a pair of inwardly telescoping members 31 and 32, which, as seen in FIG. 4, in the illustrated embodiment, comprise coaxially aligned rods. The outer end 33 of rod 31 is pivotally connected to the latch member 20 by a pivot 34 and the outer end 35 of the rod 32 is pivotally connected to the latch member 21 by a pivot 36.

As best seen in FIG. 4, inner end 37 of rod 31 is reduced in diameter and is axially movably received in an inwardly opening recess 38 in the inner end 39 of rod 32. A coil spring 40 is coaxially mounted about rod end 37 so as to be captured between rod 31 and rod 32 and bias the rods outwardly.

As further illustrated in FIG. 5, the door mounting means 16 further includes operating means comprising a bell crank 41 pivotally connected to the door top wall 23 by a pivot 42 at the juncture between a first arm 43 extending to adjacent recess 24, and a second arm 44 extending to adjacent rod end 31 and provided at its distal end with a turned flange 45 which extends upward adjacent the rod end 31.

Spring 40A cts to urge the latch members 19 and 21 to an overcenter position relative to the centered position illustrated in FIG. 5, so as to maintain the latch members therein. Thus, as seen in FIG. 4, spring 40 acts to pivot latch member 19 in a clockwise direction beyond the centered position of FIG. 5 to the open position of FIG. 4 when door side portion 14 is moved outwardly away from the cabinet by manipulation of handle 28. More specifically, as door portion 14 is moved away from the cabinet, latch member 19 is swung about pivot 20 in a clockwise direction as a result of the relative movement thereof resulting from the engagement of the latch member portion 27 with the hinge pin 17.

As indicated briefly above, FIG. 5 illustrates closing movement of the left-hand side 14 of the door. As shown therein, as the door portion 14 is swung inwardly toward cabinet 11, hinge pin 17 engages arm 43 of the bell crank 41 and pivots it in a counterclockwise direction so as to urge turned flange 45 in a counterclockwise direction against rod end 33, thereby swinging latch member 19 in a counterclockwise direction on pivot 20 as a result of the movement of pivot 34 between the rod end 33 and latch member 19. Once latch member 19 is swung beyond the center position of FIG. 5 by the crank arm portion 45, the latch member is snapped to the latching position by the biasing action of spring 40, urging the latch member 19 further resiliently about pivot 20 so as to bring the latching portion 27 of the latch member fully behind the hinge pin 17. In so moving, the rod end 33 moves away from the crank arm portion 45, as illustrated in FIG. 3.

Locking means 30 defines means for positively maintaining the latching association of one latch member with its associated hinge pin when the opposite latch member is swung to the open position as a result of opening movement of the door. Thus, as seen in FIG. 4, when latch member 19 is swung to the open position, locking structure 30 effectively maintains latch member 21 in latching association with hinge pin 18 so as to prevent undesirable removal of the door from the cabinet. To effect such locked retention of the latch member 21, locking structure 30 includes stop means preventing inward telescoping of the rod 32 on end 37 of rod 31 sufficiently to permit latch member 21 to become disengaged from hinge pin 18. More specifically, as shown, the length of rod end 37 is preselected so as to cause bottoming of the rod end 37 in recess 38 when the latched latch member is urged away from the latching position when the other latch member is in the open position, such as illustrated in FIG. 4. Such bottoming occurs because, when the latch member 21 is arranged in the latching position shown in FIG. 4, arcuate movement of pivot 36 includes a substantial component of movement parallel to the axis of rod 32.

However, as can be further seen in FIG. 4, the open position of the latch members is such that the pivotal connection thereof to the associated rod member is closely adjacent the centerline between the latch member pivot connection to the door, such as pivot 20, and the pivotal connection of the other rod member to the other latch member, such as pivot 36. Resultingly, only a small component of the arcuate movement of pivot 34 is directed parallel to the rod 31, and only a small further telescopic movement of the rod end 37 in recess 38 occurs, so that the rod members 31 and 32 do not bottom out as the open latch member, latch member 19, moves past the center position in either direction in the operation of the door mounting means.

Thus, as seen in FIG. 4, the distance between pivot 36 and a line between pivot 22 and pivot 34 when the latch member 19 is in the open position and the latch member 21 is in the closed position is substantially greater than the distance between pivot 34 and a line between pivot 20 and pivot 36, resulting in the desirable controlled bottoming and positive locking operation of locking structure 30, as discussed above.

The arrangement of the mounting structure at the left side 14 of the door is reversely similar to the arrangement thereof at the right side 15, as seen in FIG. 3. Similarly, the arrangement of the mounting structure in the lower mounting means 16 is identical to the arrangement in the upper means 16, as seen in FIG. 1, and functions in an identical manner.

Thus, in broad summary, the improved door mounting means of the present invention utilizes a pair of latch members 19,21 pivotally mounted to the door at opposite sides thereof for selective engagement with hinge pins 17,18 respectively, in such a manner as to permit opening of the door from either side. An improved locking means 30 is provided for positively retaining the side of the door being pivoted on the cabinet when the other side of the door is moved to an open position in latched association with the hinge pins so as to positively prevent complete removal of the door from the cabinet when the door is opened from either side. The mounting means includes biasing means 40 for resiliently urging the latch members selectively to the latching and open positions at either side of a centered position, so as to provide automatic control of the positioning of the latch members.

The door mounting structure is extremely simple and economical while yet providing an improved, selectively left or right opening of the door on the cabinet and, thus, the enclosure structure 10 of the invention is advantageously adapted for use with refrigeration apparatuses, such as refrigerators, freezers, and the like.

The foregoing disclosure of specific embodiments is illustrative of the broad inventive concepts comprehended by the invention.

Having described the invention, the embodiments of the invention in which an exclusive property or privilege is claimed are defined as follows:

1. In an enclosure structure having a cabinet defining an access opening, and a door for selectively closing said opening defining opposite sides, improved mounting means for mounting the door to the cabinet for releasably retaining the door in a closed position across the opening and permitting the door to be swung open outwardly from either of said sides to an open position, said improved mounting means comprising:

first hinge pin means fixed to the cabinet at one side of said opening;

second hinge pin means fixed to the cabinet at the opposite side of said opening;

a first latch member pivotally mounted to one side of said door for selective positioning in a latching position in latched association with said first hinge pin means and an open position, said latching and open position being oppositely overcentered relative to a center position;

a second latch member pivotally mounted to the opposite side of said door for selective positioning in a latching position in latched association with said second hinge pin means and an open position, said latching and open positions being oppositely overcentered relative to a center position;

means on said door cooperating with the latch members to form latch means for retaining the hinge pin means in pivotal relationship with the door when the latch members are in said latching position; and locking means operably associated with each of said latch member for effectively maintaining either latch member in said latching position in latched enclosing association with its associated said hinge pin means as an incident of positioning of the other of said latch members in the open position thereof, thereby preventing the door from becoming completely unhinged from the cabinet, said locking means comprising a resiliently extensible and contractible rod having one end pivotally connected to said first latch member and an opposite second end pivotally connected to the other latch member, said rod biasing said latch members to said overcentered positions, and a pair of lever means movably mounted on said door and associated one each with the opposite ends of the rod, each lever means having a first portion engageable with the rod end and a second portion disposed in the path of movement of the hinge pin means to cause said first portion to move the rod and thereby pivot the latch member relative to both the rod and the door into the latching position as an incident of the hinge pin means being moved into latching association with the associated said latch member and into concurrent engagement with said lever means second portion, each said latch member being pivoted to the overcenter open position thereof as an incident of the associated said hinge pin means being withdrawn from the latch means, said rod positively retaining the opposite latch member in the closed position whenever either latch member is pivoted to the open position as a result of said hinge pin means.

2. The enclosure structure of claim 1 wherein said rod includes sprim means for biasing said latch members selectively to said overcenter latching and open positions.

3. The enclosure structure of claim 1 wherein each said lever means comprising a bell crank pivotally mounted to said door.

4. The enclosure structure of claim 1 wherein said rod comprises a pair of inwardly telescoping members having opposite distal ends connected one each to said first and second latch members, and stop means for preventing further inward telescoping when either one of said latch members is in the open position.

5. The enclosure structure of claim 4 wherein said stop means establishes a minimum length of said telescoping members which prevents overcenter movement of one of said latch members to the open position when the other said latch members is in the open position.

6. The enclosure structure of claim 1 wherein means are provided on said door for limiting pivotal movement of said latch members away from said latching positions, thereby to define preselected fully open overcenter positions of the latch members.

7. The enclosure structure of claim 1 wherein means are provided on said door for limiting pivotal movement of said latch members away from said latching positions to an overcenter position wherein the pivotal connection thereof to the associated connecting member is closely adjacent a center-to-center line between said first and second pivotal connections, thereby to define preselected fully open overcenter positions of the latch members.

8. The enclosure structure of claim 1 further including operating means movably carried by said door for moving said latch members from said open position to said latching position as an incident of movement of the door to said closed position.

9. The enclosure structure of claim 1 further including operating means movably carried by said door and responsive to engagement with a hinge pin as an incident of closing movement of the door for moving said latch member from said open position to said latched position.

10. The enclosure structure of claim 1 wherein said spring means comprises spring means acting outwardly between said rod ends.

* * * * *